United States Patent [19]

Griffith et al.

[11] 4,078,993

[45] Mar. 14, 1978

[54] PROCESSES FOR FLOTATION OF MINERAL SUBSTANCES

[75] Inventors: Robert M. Griffith, Shipley; Christopher Parkinson, Halifax; Ronald A. Palmer, Bradford, all of England

[73] Assignee: Allied Colloids Limited, Bradford, England

[21] Appl. No.: 659,890

[22] Filed: Feb. 20, 1976

[30] Foreign Application Priority Data

| | | |
|---|---|---|
| Mar. 6, 1975 | United Kingdom | 9326/75 |
| Jun. 12, 1975 | United Kingdom | 25168/75 |

[51] Int. Cl.[2] ..... B03D 1/02

[52] U.S. Cl. ..... 209/167

[58] Field of Search ..... 209/166, 167

[56] References Cited

U.S. PATENT DOCUMENTS

| | | | |
|---|---|---|---|
| 2,187,930 | 1/1940 | Brown et al. | 209/167 |
| 2,471,384 | 5/1949 | Booth et al. | 209/167 |
| 2,664,198 | 12/1953 | Hines | 209/167 |
| 2,740,522 | 4/1956 | Aimone et al. | 209/166 |
| 3,017,028 | 1/1962 | Schoeld et al. | 209/167 |
| 3,235,077 | 2/1966 | McGarry et al. | 209/166 |

FOREIGN PATENT DOCUMENTS

| | | | |
|---|---|---|---|
| 630,213 | 10/1949 | United Kingdom | 209/166 |
| 276,845 | 7/1970 | U.S.S.R. | 209/167 |

*Primary Examiner*—Morris O. Wolk
*Assistant Examiner*—Arnold Turk
*Attorney, Agent, or Firm*—Lawrence Rosen; E. Janet Berry

[57] ABSTRACT

A method of concentrating a metalliferous ore containing also substantial quantities of pyrites and/or pyrrhotite and/or sphalerite and comprises subjecting an aqueous pulp of the ore to a froth flotation process in the presence of a depressant and in which (1) pyrites and/or pyrrhotite, and/or (2) sphalerite, is depressed by using as the depressant a condensation product of an aldehyde with a compound containing at least two amine or amide groups.

10 Claims, No Drawings

PROCESSES FOR FLOTATION OF MINERAL SUBSTANCES

This invention relates to improvements in the beneficiation of metalliferous mineral ores and especially to the beneficiation of metalliferous sulphide minerals associated with pyrite, pyrrhotite and sphalerite gangue minerals.

The use of froth flotation processes for the beneficiation of mineral ores is very well known. The object of the process usually is to produce a concentrate of a certain mineral substance from the crude ore in which the required mineral substance is diluted by the presence of other minerals which are unavoidably extracted with it in the mining operation. The essential features of the froth flotation process consist of first grinding the crude ore to such an extent that discrete particles of the required mineral occur and then subjecting an aqueous "pulp" of the crude ground ore to agitation in the presence of rising air bubbles.

To assist the process a chemical substance known as a "collector" is incorporated into the mass and by virtue of its chemical and physical properties this collector will selectively absorb onto one or more of the minerals present in such a way that these minerals in preference to the other minerals, become attached to the air bubbles. In this way the preferred minerals rise to the surface of the aqueous mass from whence they can be collected and a degree of mineral separation is thus brought about. In some cases the "gangue" or unwanted minerals are caused to float preferentially in this way, but more commonly the valuable minerals are floated and collected as a concentrate.

Complete selectivity with regard to separation of the minerals is difficult to achieve and frequently several sequential flotations are required before an adequate degree of ore refinement is obtained. Those flotations carried out on the crude ore are often referred to as "rougher" operations and reflotations of the "rougher" concentrates are often referred to as "cleaner" operations.

It is well known to add other chemical reagents to improve the selectivity of flotation processes, amongst which are substances which are termed "depressants" because of their general effect on the process which is to make the unwanted minerals less likely to be floated simultaneously with those which are required to be floated. The manner in which these modifying agents achieve their effect is not known with certainty and various theories have been offered as to their mode of action. It is possible that some of these materials act by preferential absorption onto the surface of the unwanted material and in consequence reduce the state of flocculation of these minerals or decrease their hydrophobic properties, both of which would give them less tendency to adhere to the air bubbles, or they may prevent the associated minerals from adhering to the required minerals, or they may prevent the "collector" from absorbing onto the associated minerals or other mechanisms may be operative. Whatever the mechanism the utilisation of a "depressant" can have a valuable effect on the economics of the flotation process.

The variety of mineral substances which are subject to beneficiation by the froth flotation process is very wide and because very wide differences in the nature of the surfaces of these minerals and in the nature of the surfaces of the associated minerals exist because of chemical composition, prior processing etc., the number and type of chemical substances used as collectors is also very wide. Likewise the number and type of chemical substances used as depressants is very wide and in fact with regard to both types of materials a high degree of specificity of action exists.

Substances used in the past as gangue depressants in flotation processes cover a wide variety of chemical types and include, for instance, sodium silicate, starch, tannins, dextrins, lignosulphonic acids, carboxyl methyl cellulose, cyanide salts and many others. More recently certain synthetic polymers have been found advantageous in particular processes.

A very general disclosure of the use of synthetic polymers is in British Patent Specification No. 749,213. This describes how water soluble, anionic, linear addition polymers can be used as gangue depressants. It is stated that the invention is applicable "to gangue slimes of the most varied types of ores such as siliceous gangue present in metallic or sulphide ores, for example, lead, zinc, copper, pyrites, lead-zinc ores, precious metal ores. It is also applicable to the various gangues present in non-sulphide ores such as, for example, those of tungsten, manganese, barites, fluorspar, limestone and phosphate rock." It is clear that the depressant is intended to depress the gangue.

Although a very large number of polymers are listed in the Specification, including for instance polyacrylamide, the only depressants used in the actual working examples are polyacrylic acid and hydrolysed polyacrylonitriles, the latter being stated to be preferred.

In view of the high specificity of action of synthetic polymers as depressants it is perhaps rather unlikely that really useful results will be achieved with the many hundreds or thousands of theoretically possible combinations of disclosed ores and disclosed polymer types. Indeed most literature on the use of synthetic polymers as depressants is very much more specific. Other literature on the use of acrylic polymers as depressants includes South African Pat. No. 67/2678, German Pat. No. 1,267,631 and U.S. Pat. No. 3,452,867, and U.S. Pat. No. 3,017,028 has described the use of certain condensation products as clay depressants in the flotation of potash. More recently French Pat. No. 1,175,174 has described the use of quaternary polymers of diallyl dialkyl ammonia as depressants for use in sulphide circuits.

Many non-ferrous metals are found in the form of metalliferous minerals in ores containing substantial quantities of pyrites and/or pyrrhotite and/or sphalerite. In particular these ores are often sulphide or oxidised sulphide ores. It has been our object to devise a froth flotation process in which a depressant is used which has the effect of resulting in improved concentration of the metalliferous minerals while the pyrites and/or pyrrhotite and/or sphalerite is depressed.

It will be observed that in British Patent Specification No. 749,213 pyrites was one of the minerals that apparently was intended to be floated, the gangue being depressed.

According to the invention we concentrate metalliferous ores containing also a substantial quantity of pyrites and/or pyrrhotite and/or sphalerite by subjecting an aqueous pulp of the ore to a froth flotation process in the presence of a depressant and in which (1) pyrites and/or pyrrhotite, and/or (2) sphalerite, present in the ore are depressed by using, as the depressant, a solution or dispersion of a condensation product of an aldehyde with a compound containing two to six (often two or three) amine or amide groups.

It seems that stated condensation products act as depressants for pyrites and/pyrrhotite and/or unactivated sphalerite and so their use results in improved concentration by flotation of the desired metalliferous component from an ore containing any or all of pyrites, pyrrhotite and sphalerite. Accordingly the invention is applicable in principle to any metalliferous ore containing also pyrites and/or pyrrhotite and/or sphalerite in which the metalliferous component is one that does float when pyrites is depressed.

The ores to which the invention is most suitably applied are sulphide ores containing substantial quantities of pyrites and/or pyrrhotite and/or sphalerite and oxidised sulphide ores which, despite having been oxidised, contain substantial quantities of pyrites and/or pyrrhotite and/or sphalerite. The invention is of most value when the amount of pyrites and/or pyrrhotite and/or sphalerite is above 10%, and in particular when it is above 20%. e.g. 25 to 40% by weight of the total weight of ore.

The desired metalliferous component of the ore may comprise minerals, generally the sulphide or oxide, of metals such as copper, nickel, lead and zinc. Most such minerals will float preferentially in a system in which pyrites and/or pyrrhotite is depressed but zinc minerals in particular have an inherent tendency not to float and so it is well known to include an activator to promote their flotation. Accordingly in the invention sphalerite can be depressed or not according to the manner in which the flotation is conducted, and in particular according to whether or not activator is present. The sphalerite may be activated by other components of the ore, for instance copper, but if not and if it is desired to be floated then suitable activators that may be added include copper and lead salts, for example copper sulphate and lead nitrate. Thus, the invention is applicable to processes in which pyrites and/or pyrrhotite are to be depressed while sphalerite is floated and to processes in which sphalerite is depressed, often in combination with pyrites and/or pyrrhotite, while other metaliferous component is floated. In the Examples below it will be observed that in some processes ores containing sphalerite have the concentration of sphalerite increased by the invention while in others ores containing sphalerite have the concentration of other components increased, the sphalerite being depressed.

Thus a preferred process according to the invention for concentrating an ore containing sphalerite and other metalliferous, as well as pyrites and/or pyrrhotite, comprises subjecting the ore to flotation concentration in accordance with the invention in such a manner that both (1) pyrites, and/or pyrrhotite and (2) sphalerite are depressed and then subjecting it to another process that results in sphalerite being floated while pyrites and/or pyrrhotite is depressed, usually by conducting the process of the invention in the presence of an activator for the sphalerite.

The invention is primarily of use when the amount of pyrites and/or pyrrhotite and/or sphalerite that is to be depressed is more than 10%, and in particular when it is above 20%, e.g. 25 to 40% by weight of the total weight of ore. Naturally if the sphalerite is to be floated then it must be excluded from these quantities which would then apply solely to the pyrites and pyrrhotite content of the ore. Generally the ore contains the specified quantities of pyrites alone, optionally with additional pyrrhotite and/or sphalerite.

The aldehyde condensation products used in the invention must of course be water soluble or dispersible. This requirement is conventional for depressants. By water dispersible we merely mean that it must be possible to make a dispersion in water that has temporary stability at least, that is to say does not promptly settle out. It may be permanently stable or may gradually settle out upon storage over a period of at least several minutes. In particular by water dispersible we mean that it shall be possible to make a homogeneous mixture of the ore, depressant and water. If necessary the depressant may be formulated as an aqueous dispersion having a pH at which it is stable, prior to its use as a depressant. For instance a colloidal suspension may be formed, e.g. at an acidic pH, and this then used as depressant.

If the products have too high a molecular weight they will not generally be suitable in the invention. Typically the molecular weight is such that an aqueous solution or dispersion containing 20% by weight of the product has a viscosity of 1 to 1000 centistokes measured at 20° C by a suspended level viscometer.

The aldehyde used in forming the condensation product preferably contains not more than four carbon atoms and usually is acetaldehyde or, preferably, formaldehyde. The compound containing at least two amine or amide groups must be one in which these groups are capable of reacting with the aldehyde. Thus the amine groups must be primary or secondary, and the nitrogen atom in the amide groups must also be primary or secondary. The amine groups may be amidine groups. Preferred compound are ureas, guanidines and melamines. Examples of suitable compounds for condensation with the aldehyde may have one of the following formulae:

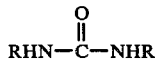

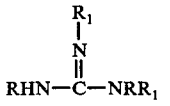

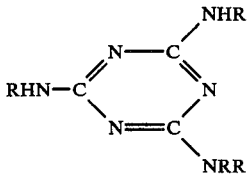

wherein at least one of the radicals $R_1$ is hydrogen and the other is R, and the radicals R may be the same or different and are selected from hydrogen and aliphatic and aromatic radicals, usually $C_{1-8}$ alkyl radicals. Preferred values of R are hydrogen, methyl and ethyl. From the cost point of view it is generally preferred that all radicals R are hydrogen. Salts of these compounds, such as guanidine salts, may also be used. Biuret and its substituted derivatives are also useful.

A suitable condensation product may be prepared using urea and formaldehyde, both of which are commercially available, and relatively inexpensive. A number of alternative materials such as melamine, guanidine and substituted ureas may be used in place of urea. Alternatively aldehydes such as acetaldehyde may be used in place of formaldehyde. Furthermore condensation products of mixed carbamides, and aldehydes may be prepared and used as depressants according to the invention.

The depressants of this invention may be prepared by methods well known for the formation of low molecular weight condensate resins. Thus the molar ratio of the compound containing the amide or amine groups: aldehyde may be from 2 : 1 to 1 : 4, but preferably is from 1 : 1 to 1 : 3. The reaction temperature may be from 30° C to 120° C, but preferably is the reflux temperature, preferably at atmospheric pressure. Conventional catalysts may be used such as catalysts that will give a reaction pH of 5 to 9, preferably 6 to 8, e.g. ammonia and alkali metal or alkaline earth metal hydroxides such as sodium hydroxide and optionally also acid, such as acetic acid. The reaction stops or is stopped when the desired viscosity is achieved.

Although varying molar ratios of aldehyde and amide, amine, or amidine may be used to prepare the resin; the resulting polymeric molecules will contain alternate sections derived from the aldehyde and the amine, amide or amidine. It is to be expected that there will be a degree of chain branching, but the polymeric backbone of the molecule will contain approximately equimolar amounts of aldehyde and amine, amide or amidine. Where an amide, amine or amidine is used which may react with more than two molecules of aldehyde it is to be expected that a relatively high degree of chain branching will take place, and also that a certain amount of the aldehyde will react with the additional amide, amine or amidine groups to form substituted amide, amine or amidine groups and thereby be incorporated into the polymer molecule, without being a part of the polymer backbone. Thus a resin of urea and formaldehyde will contain equimolar amounts of urea and formaldehyde in the polymer chain, but the resin may contain additional formaldehyde so that the overall ratio of formaldehyde to urea may vary from 3 : 1 to 1 : 1.

In the case of some condensate resins, especially melamine resins such as a melamine -formaldehyde resin, the resin may be advantageously used as a depressant in the form of an acid colloid. This may be prepared by adding the resin to a hydrochloric or other acid/water mix at 35°–40° C with stirring. After aging for 4 hours and dilution a stable colloid is formed.

The use of the depressants in the invention gives good results at very economical dosage levels, in general in the range of 5 to 250 gm of depressant per tonne of solid ore in the flotation feed. Hereinafter these dosages will be referred to in the abbreviated form of 5 to 250 gm per tonne. In one instance good results have been obtained using a dose of depressant corresponding to about 170 gms per tonne, but in other instances doses of 70 gms/tonne or less have proved sufficient. The use of an excessive amount of depressant will usually lead to a fall in the recovery of the mineral which is being floated.

The froth flotation of the present invention should be carried out in accordance with good flotation practice and critical or unusual techniques are not necessary. In general any mechanical flotation machine may be employed or air cells may be used. For the purpose of this invention the collectors usually employed for collecting the ore may be used, for example, the commercially available xanthate collectors.

It is a necessary requirement of this invention that a collector is used under conditions which, in the absence of depressant, allow good flotation of the minerals that are required to be floated.

The pH vary widely, but in common with other flotation systems separating metalliferous minerals from pyrite, high pH values, e.g. 8 to 12 give best results. Conventional frothers, e.g. Methyl Isobutyl Carbinol, pine oil or polypropylene oxides may be used in accordance with normal flotation practice.

As in conventional flotation practice, the natural ore being beneficiated is usually first ground to the "liberation mesh" size and slurried with water. The depressant is added to the slurried ore whilst the ore is agitated. The collector may then be added in water solution to the agitated slurry and after a short time the slurry may be treated by conventional methods of froth flotation. The depressant should be added to the slurry in a manner such that the depressant may readily be dispersed throughout the slurry.

The froth flotation of the present invention commonly though not always involves flotation in "rougher cells" followed by one or more "cleanings" of the rougher concentrate. In some instances, however, it is common practice to carry out a "bulk sulphide" flotation designed to separate all the sulphide minerals together, and this is then followed by a selective flotation to remove metal values from the remaining pyritic gangue. The present invention can be used to advantage in both instances, either during the selective flotation of sulphide minerals from the ore, or during the selective removal of metal values from a previously floated "bulk sulphide" concentrate.

It is possible to carry out rougher and cleaner flotations with single additions of collecting and depressing reagents at the beginning of the operation. On the other hand it is often advantageous to use additions of collecting and depressing reagents at each flotation stage. The exact reagent additions at each stage will depend on the grade of the ore and the associated minerals. Pulp densities are in general the same as in other applications of froth flotation, for example between about 15 to 45% of solids by weight.

While it is practical, and in most operations preferable, to float with the depressants as the only depressants, it is also possible to use them in conjunction with other depressants, such as the known depressants including e.g. soluble silicates, lignosulphonates and cyanide salts.

A number of urea/formaldehyde and melamine/formaldehyde resins which would be suitable for use in the present invention are commercially available but the following method describes the preparation of one particularly suitable depressant polymer, hereinafter called depressant "A".

Preparation of Depressant A — a Urea/Formaldehyde Resin 125 gms of 36% formaldehyde solution was mixed with 30 gms of urea, in the presence of 2.8 gms of 0.880 ammonia solution, 0.02 gms of sodium hydroxide and 0.3 gms of acetic acid. This composition was refluxed for one hour and a viscous solution was produced. This solution was allowed to stand for four days, and during this period became more viscous. The increase in viscosity was halted by the addition of 1 gm of sodium hydroxide to give a solution having an ultimate viscosity of 26.9 cs. Resins produced in this manner having a higher viscosity, e.g. above 10 cs and preferably above 20 cs, have been found to be more selective than those of lower viscosity.

The following examples illustrate the invention.

EXAMPLE 1

The flotation feed was a copper ore containing chalcopyrite, pyrite, covellite, chalcocite and andesine with minor amounts of sphalerite, silica, montamarillonite clay, carbonates and metal oxides. After grinding, the ore assaying about 1.5% copper was treated by a laboratory Wemco Fagergren flotation cell as follows: A rougher concentrate was removed in three stages at a pH of 11.5 using commercially available Isopropyl ethyl thionocarbamate at doses of 10 gm. per tonne, 10 gm. per tonne and 20 gm. per tonne respectively in the presence of about 200 gm. per tonne of the depressant polymer "A". The depressant was added three minutes before the first dose of collector, and after each addition of collector a further three minute conditioning period was allowed before flotation was commenced. Methyl Isobutyl Carbinol frother was used at a dose of 80 gms/tonne at the first and third stages of flotation. The following results were obtained:

| | % Weight of Floated Concentrate | % Copper Assay | % Copper Distribution |
|---|---|---|---|
| 1st Rougher Conc. | 16.7 | 4.4 | 49.1 |
| 2nd Rougher Conc. | 10.2 | 1.7 | 12.3 |
| 3rd Rougher Conc. | 6.0 | 1.8 | 7.5 |
| Tails | 67.1 | 0.66 | 31.1 |
| | 100.0 | 1.43 | 100.0 |

As a control experiment an identical sample of ore was treated using the same procedure, but omitting the addition of depressant. The following results were obtained.

| | % Weight of Floated Concentrate | % Copper Assay | % Copper Distribution |
|---|---|---|---|
| 1st Rougher Conc. | 21.1 | 3.5 | 50.7 |
| 2nd Rougher Conc. | 10.3 | 1.7 | 12.1 |
| 3rd Rougher Conc. | 7.8 | 1.9 | 10.1 |
| Tails | 60.8 | 0.65 | 27.2 |
| | 100.0 | 1.46 | 100.0 |

EXAMPLE 2

The flotation feed was a zinc ore containing sphalerite together with pyrite and siliceous gangue minerals including silica and tourmaline and small amounts of chalcopyrite arsenopyrite and cassiterite. After grinding, the ore, assaying about 3.5% zinc, was treated using a Denver laboratory flotation cell. A rougher concentrate was removed at a pH of 11.5 using commercially available potassium amyl xanthate at a dose of 30 gms/tonne. Two minutes before the addition of collector, 90 g/tonne $CuSO_4.5H_2O$ was added as activator for the sphalerite. The depressant "A" of example 1 was added at a dose of 30 g/tonne two minutes after the collector addition, and flotation was commenced a further two minutes later. The average results of two tests were:

| | % Weight | Zinc Assay | Zinc Distribution |
|---|---|---|---|
| Concentrate | 16.2 | 17.8% | 85.2% |
| Tails | 83.8 | 0.6% | 14.8% |
| | 100.0 | 3.4% | 100.0% |

A control experiment using the same procedure was carried out using an identical sample of ore, omitting only the depressant addition and subsequent conditioning time. The following results were obtained:

| | % Weight | Zinc Assay | Zinc Distribution |
|---|---|---|---|
| Concentrate | 20.5 | 15.4% | 87.3% |
| Tails | 79.5 | 0.7% | 12.7% |
| | 100.0 | 3.6% | 100.0% |

EXAMPLE 3

A flotation feed similar to that of example 2 was treated using the same procedure, and using the same depressant, but at a dose of 45 gms/tonne. The following results were obtained:

| | % Weight | Zinc Assay | Zinc Distribution |
|---|---|---|---|
| Concentrate | 13.4 | 24.2% | 86.1% |
| Tails | 86.6 | 0.6% | 13.9% |
| | 100.0 | 3.8% | 100.0% |

A control experiment was carried out omitting only the depressant addition. The following results were obtained:

| | % Weight | Zinc Assay | Zinc Distribution |
|---|---|---|---|
| Concentrate | 17.7 | 18.5% | 83.2% |
| Tails | 82.3 | 0.8% | 16.8% |
| | 100.0 | 3.9% | 100.0% |

EXAMPLE 4

The flotation feed was a lead ore containing galena, sphalerite and pyrite and siliceous gangue materials. After grinding, the ore, assaying about 2% lead, was treated using a Denver laboratory flotation cell. A rougher concentrate was removed at a pH of 9.5 using sodium isopropyl xanthate at a dose of 80 gms/tonne. MIBC frother was used at a dose of 80 gms/tonne. The depressant of example 1 was used at a dose of 100 gms/tonne. The depressant was added three minutes after the collector and a further three minutes conditioning was allowed after the depressant addition before flotation was commenced. A concentrate assaying 7.4% lead was obtained with a recovery of 79.1% from a feed assaying 1.9% lead.

As a control experiment the same procedure was carried out on an identical sample of ore, omitting only the depressant addition and subsequent conditioning period. A concentrate assaying 6.0% lead with a recover of 79.4% was obtained from a feed assaying 1.9% lead.

EXAMPLE 5

The flotation feed and procedure of example 4 were used. A commercially available melamine/formaldehyde resin was used at a dose of 66.7 gms per tonne. The resin, which is available as a powder containing 39% nitrogen, was dissolved in hydrochloric acid solution to form an acid colloid. A concentrate assaying 8.9% lead with a recovery of 71.3% was obtained from a feed assaying 1.8% lead.

Examples 1–5 show the effectiveness of depressant A in the separation of copper, lead and zinc ores.

EXAMPLE 6

The flotation was a lead/zinc ore containing galena and sphalerite together with pyrite and silicous gangue minerals. After grinding, the ore, assaying about 1.2% lead and 5.5% zinc was treated using a Denver Laboratory Flotation cell. A rougher concentrate was removed at a pH of 10.5 using 20 g/t of a commercially available dithiophosphate collector together with 20 g/t of MIBC frother. In test A depressant A was used at a dose of 20 g/t. Test B is a control test carried out using no depressant. The results were as follows.

| | | A | B |
|---|---|---|---|
| Head Grade | Pb | 1.12 | 1.14 |
| | Zn | 5.60 | 5.37 |
| | Fe | 6.15 | 6.09 |
| Concentrate Grade | Pb | 20.72 | 16.66 |
| | Zn | 22.66 | 23.90 |
| | Fe | 4.85 | 5.63 |
| % Recovery | Pb | 91.5 | 92.5 |
| | Zn | 20.0 | 28.2 |
| | Fe | 3.9 | 5.9 |

These figures show that while lead minerals have been depressed to a very small extent, zinc and iron minerals have been depressed to a much greater extent.

Preparation of Depressant B — a biuret/formaldehyde resin 30 gms of Biuret and 125 gms of 36% Formaldehyde solution were refluxed for one hour in the presence of 3.2 mls of 0.880 Ammonia, 2 mls of 1% Sodium Hydroxide and 3 mls of 10% Acetic acid. The resulting resin had a viscosity of 4.7 cs.

Preparation of Depressant C — a guanidine salt/formaldehyde resin 45 gms of the Hydrochloride salt of Guandine and 125 gms of 36% Formaldehyde solution were boiled together, and 45 mls of distillate was collected in about twenty minutes. The residual resin had a viscosity of 7.8 cs.

EXAMPLE 7

The flotation feed was a zinc ore similar to that of Example 2. After grinding the ore was treated using a Denver Laboratory Flotation Cell. A rougher concentrate was removed at a pH of 11 using 200 mls/tonne of a commercially available isopropyl ethyl thionocarbonate collector. Copper sulphate was used as activator at a dose of 100g/tonne, and Depressant B was used at a dose of 75g/tonne. Reagents were added in the following order, first Copper Sulphate, followed by collector, followed by depressant, and each reagent addition was followed by a three minute conditioning period. Flotation was carried out for three minutes, with the following results.

| | | |
|---|---|---|
| Yield of floated Concentrate | | 11.9% |
| Concentrate Grades | Zn | 19.9% |
| | Cu | 3.2% |
| | Fe | 17.0% |
| Metal Recoveries | Zn | 71.8% |
| | Cu | 64.2% |
| | Fe | 15.8% |
| Calculated Head Grades | Zn | 3.28% |
| | Cu | 0.59% |
| | Fe | 12.8% |

As a control experiment another sample of the same ore was treated in the same manner, omitting only the depressant addition. The following results were obtained.

| | | |
|---|---|---|
| Yield of floated concentrate | = | 12.8% |
| Concentrate Grades | Zn | 18.2% |
| | Cu | 3.1% |
| | Fe | 20.9% |
| Metal Recoveries | Zn | 70.9% |
| | Cu | 68.5% |
| | Fe | 23.0% |
| Calculated Head Grades | Zn | 3.29% |
| | Cu | 0.58% |
| | Fe | 11.7% |

EXAMPLE 8

The ore and procedure of Example 7 were used, except that Depressant C was used at a dose of 250 g/t. The following results were obtained.

| | | |
|---|---|---|
| Yield of floated concentrate | = | 11.9% |
| Concentrate Grades | Zn | 20.9% |
| | Cu | 3.4% |
| | Fe | 17.6% |
| Metal Recoveries | Zn | 73.8% |
| | Cu | 67.6% |
| | Fe | 17.0% |
| Calculated Head Grades | Zn | 3.37% |
| | Cu | 0.60% |
| | Fe | 12.3% |

EXAMPLE 9

The flotation feed was a nickel sulphide ore containing a substantial amount of pyrrhotite. After grinding, the ore, assaying about 2.5% nickel, was treated using a Denver laboratory flotation cell. A rougher concentrate was removed in two stages at a pH of 10 using potassium amyl xanthate as collector at doses of 100 gms/tonne and 50 gms/tonne. MIBC frother was used at a dose of 40 gms/tonne at each stage. Depressant A was used at a dose of 50 gms/tonne at the first stage, and was added three minutes after the addition of collector. A four minute conditioning period was then allowed before flotation was commenced, the frother being added after three minutes. No depressant was added at the second stage of flotation, and the collector was allowed a four minute conditioning period before flotation was commenced, the frother being added after three minutes. Flotation was carried out for five minutes at the first stage and for four minutes at the second. The following results were obtained:

| | % Weight floated | Assays % N | Assays % Fe | Distributions % N | Distributions % Fe |
|---|---|---|---|---|---|
| 1st. Rougher Concentrate | 14.5 | 11.1 | 26.8 | 65.0 | 20.9 |
| 2nd. Rougher. Concentrate | 6.5 | 4.2 | 31.4 | 11.1 | 11.0 |
| Tails | 79.0 | 0.75 | 16.0 | 23.9 | 68.1 |

-continued

| | % Weight floated | Assays % N | Assays % Fe | Distributions % N | Distributions % Fe |
|---|---|---|---|---|---|
| | 100 | 2.5 | 18.6 | 100 | 100 |

As a control experiment another sample of the same ore was treated using the same procedure, omitting only the depressant addition. The following results were obtained:

| | % Weight floated | Assays % N: | Assays % Fe | Distributions % N: | Distributions % Fe |
|---|---|---|---|---|---|
| 1st Rougher Concentrate | 18.4 | 9.1 | 27.6 | 67.7 | 27.8 |
| 2nd Rougher Concentrate | 7.4 | 3.4 | 31.0 | 10.3 | 12.6 |
| Tails | 74.2 | 0.73 | 14.7 | 22.0 | 59.6 |
| | 100 | 2.5 | 18.3 | 100 | 100 |

We claim:

1. A method of concentrating a metalliferous sulphide or oxidised sulphide ore containing desired metal oxide or sulphide and containing also substantial quantities of at least one impurity selected from the group consisting of pyrites, pyrrhotite and sphalerite comprising subjecting an aqueous pulp of the ore to a froth flotation process in the presence of a collector and a depressant and in which the desired metal oxide or sulphide is collected and the said impurities are depressed by using as the depressant a solution or dispersion of a condensation product of an aldehyde with a compound containing 2 to 6 groups selected from amine and amide groups.

2. A method according to claim 1 in which the aldehyde is formaldehyde or acetaldehyde.

3. A method according to claim 1 conducted in the presence of a xanthate collector.

4. A method according to claim 1 in which the depressant is a melamine formaldehyde resin and is used in the form of an acid colloid.

5. A method according to claim 1 in which the compound containing amine or amide groups is selected from urea, melamine, guanidine and biuret.

6. A method according to claim 5 in which the aldehyde is formaldehyde.

7. A method according to claim 1 in which the compound containing amine or amide groups is a compound selected from biuret and compounds having the formulae

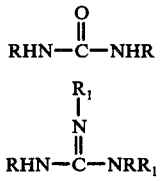

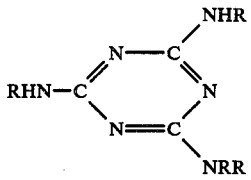

wherein the radicals R may be the same or different and are selected from hydrogen and aliphatic and aromatic radicals and at least one of the radicals $R_1$ is hydrogen and the other is R.

8. A method according to claim 7 in which the radicals R are hydrogen, methyl or ethyl.

9. A method according to claim 7 in which the radicals R and $R_1$ are all hydrogen.

10. A method of concentrating a metalliferous sulphide or oxidised sulphide ore containing desired metal oxide or sulphide as well as sphalerite and containing also substantial quantities of at least one impurity selected from the group consisting of pyrites and pyrrhotite, which comprises subjecting an aqueous pulp of the ore to a froth flotation process in the presence of a collector, a depressant and an activator selected from the group consisting of copper and lead salts and in which the desired metal oxide or sulphide and the sphalerite are collected and the said impurities are depressed by using as the depressant a solution or dispersion of a condensation product of an aldehyde with a compound containing 2 to 6 groups selected from amine and amide groups.

* * * * *